United States Patent [19]

Lunden, Jr.

[11] Patent Number: 4,523,733

[45] Date of Patent: Jun. 18, 1985

[54] LADDER ATTACHMENT FOR USE BY PAINTERS

[76] Inventor: Charles K. Lunden, Jr., Box 34, Union, Me. 04862

[21] Appl. No.: 414,930

[22] Filed: Sep. 3, 1982

[51] Int. Cl.[3] ..... E06C 7/14

[52] U.S. Cl. ..... 248/210

[58] Field of Search ..... 248/210, 211, 238; 182/129, 120

[56] References Cited

U.S. PATENT DOCUMENTS

| | | | |
|---|---|---|---|
| 2,051,060 | 8/1936 | Soman | 248/210 |
| 2,473,951 | 6/1949 | Hickey | 182/120 |
| 3,495,683 | 2/1970 | Broden | 248/210 |
| 3,822,847 | 7/1974 | Emmons | 248/210 |
| 4,036,463 | 7/1977 | Hopkins et al. | 248/210 |
| 4,418,793 | 12/1983 | Brent | 182/129 |

FOREIGN PATENT DOCUMENTS

| | | | |
|---|---|---|---|
| 683720 | 12/1952 | United Kingdom | 248/210 |

*Primary Examiner*—William H. Schultz
*Assistant Examiner*—Ramon O. Ramirez

[57] ABSTRACT

A container supporting attachment for use with ladders having tubular rungs has a rigid member provided with an anchor portion dimensioned to be entered in and held by a selected rung and a support portion including a container holder.

4 Claims, 2 Drawing Figures

LADDER ATTACHMENT FOR USE BY PAINTERS

BACKGROUND REFERENCE

U.S. Pat. No. 3,895,772.

BACKGROUND OF THE INVENTION

When the outside of a building is being painted from a ladder, it is the usual practice to employ a hanger of a type enabling a paint pail or can to be supported by its bail from a ladder rung.

A thus suspended container is in back of the ladder, and if located more or less centrally thereof, it is necessary for the painter to reach downwardly between two rungs, dip his brush in the paint or stain, bring the brush upwardly between the rungs and on the front of the ladder before spreading the paint or stain on the building. Even if the container is held by a rung adjacent a side of the ladder so that the painter may reach under that side to dip his brush into it, his work is slowed and eventually the ladder receives an appreciable amount of paint lost from the brush.

THE PRESENT INVENTION

The general objective of the present invention is to provide an attachment for connecting a container to a ladder that will afford painters greater ease and convenience in painting the exterior of a building from ladders provided that they are, as indeed are most ladders used by painters, metal ladders having tubular rungs.

In accordance with the invention, this objective is attained with an attachment having a rigid member provided with an anchor portion dimensioned to be inserted in and held by any selected rung of such a ladder and a support portion then to extend outwardly from one side of the ladder with the support portion including a container holder.

Such an attachment may be inserted into a rung from either side of the holder with the attached container then in an exposed position in which its contents are readily accessible to the painter enabling him to dip his brush therein and then spread the paint or stain where wanted, quickly and easily and with minimum loss of brush-carried material.

While the container holders may be of other types, it is preferred that the support portion have a suspended holder secured thereto, preferably rigidly, and provided with a container-supporting base and a wall structure confining the container while permitting ready access to its interior.

Another objective of the invention is to provide such a holder that will enable the bottom portion of a plastic, one gallon container to serve as light weight disposable containers that may be filled as needed from larger and heavier metal cans, an objective attained by forming such holders to provide a substantially square receiver to accommodate and confine such disposable containers formed from one gallon plastic milk containers that are square in cross section.

PRIOR ART STATEMENT

No prior art is known to me disclosing the support of a paint or stain container at the side of a ladder.

As previously discussed, it is well known to use a hook by which such a container may be held suspended in back of a ladder by a selected one of its rungs.

U.S. Pat. No. 3,895,772 is cited as of interest only that an attachment is disclosed that enables a container to be supported at the front of a ladder by two of its rungs.

BRIEF DESCRIPTION OF THE DRAWINGS

The accompanying drawings illustrate a preferred embodiment of the invention of which.

THE PREFERRED EMBODIMENT OF THE INVENTION

Figure 1:
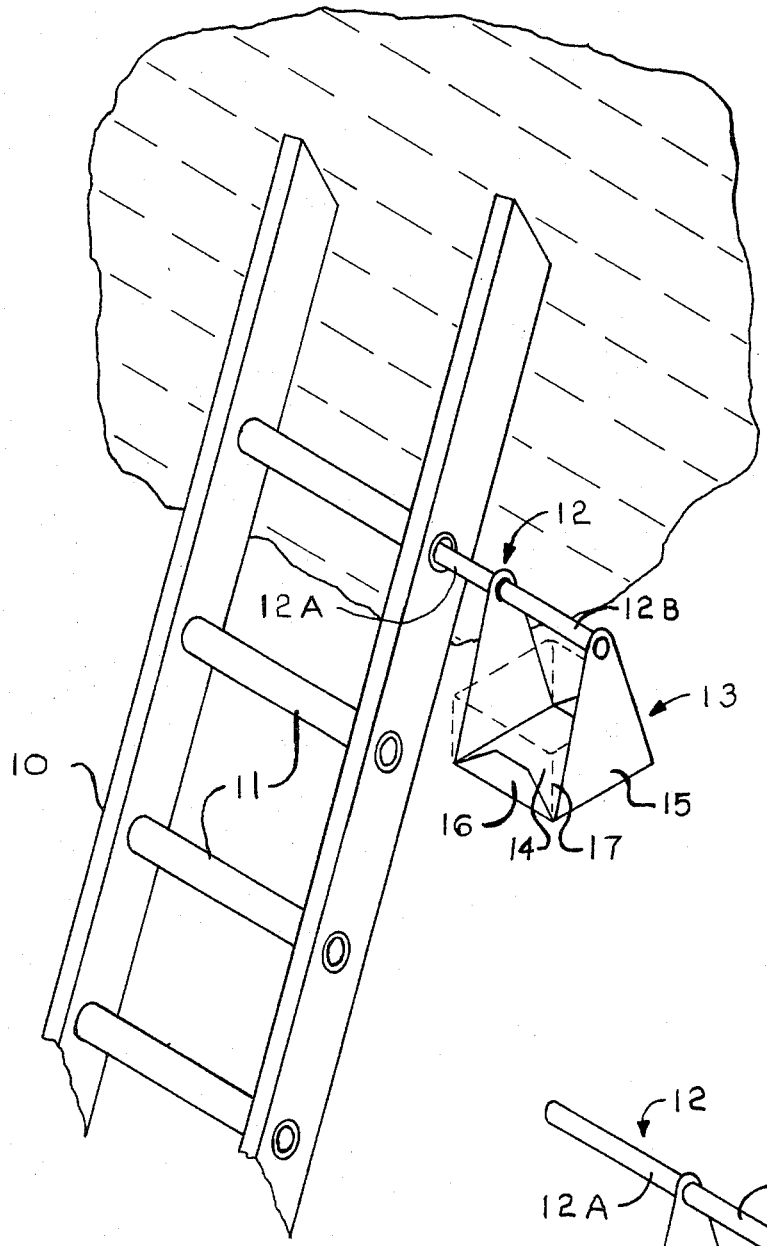
FIG. 1 is a perspective view of the attachment held at one side of a ladder.
Figure 2:
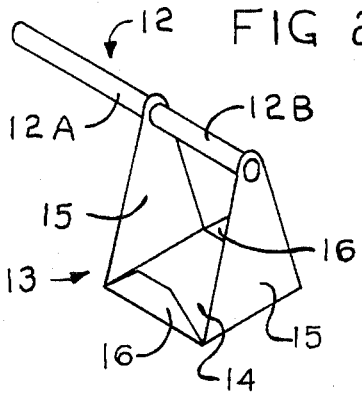
FIG. 2 is a like view of the attachment by itself.

The attachment illustrated by the drawings is for use with a metal ladder, typically but not necessarily of the extension type and generally indicated at 10 and having tubular rungs 11.

The attachment includes a rigid support generally indicated at 12 and shown as consisting of a length of tubular and preferably aluminum stock, providing an anchor portion 12A dimensioned to be a close but free fit in any of the rungs 11 and a support portion 12B that protrudes from one side of the ladder 10 when the anchor portion is inserted in a rung from that side. The rigid support 12 may have an outside diameter of one inch since the inside diameter of rungs of metal ladders are slightly larger. The length of the rigid support 10 is in the neighborhood of sixteen inches by way of example and not of limitation.

The holder is generally indicated at 13 and has a square base 14 and integral vertical end and side walls 15 and 16, respectively. The end walls 15 are shown as substantially in the form of an isosceles triangle and are provided at their upper ends with holes enabling them to be slid onto the support portion 12B and connected thereto against movement as by welds. The side walls 16 are sufficiently low to permit a container to be seated in the holder. The mid points of the bases of the sides 15 and the center of the base 14 are, accordingly, in a plane inclusive of the axis of the support portion 12B.

As stated, the base 14 is square and one reason for that shape is that the bottom half of a plastic one gallon milk container 17 may be used as a light weight disposable container that exposes a maximum area for brush entry and wiping. By way of example, such a square, disposable container may be four or five inches in height and with the base 14 a six inch square, the container 17 fits within the holder 13. With the end walls 15 dimensioned to space the base in the neighborhood of eight inches below the support 12 and the side walls 16 about two inches in height, such a container 17, even if full, can be easily placed in or removed from the holder 13 and easily filled from a larger and heavier container while held therein.

The holder is desirably made of aluminum stock so that the attachment is light in weight and easily carried by the support 12 when the painter is working from the ground level and as easily handled when the attachment is being shifted from one rung 11 to another or from one side of the ladder 10 to the other. While the support 12 is a free fit within a rung 11, once the anchor portion 12A is inserted therein, the weight of the liquid and the spacing of the holder 13 from the proximate side of the ladder 10 results in the attachment being so securely held frictionally that the attachment cannot accidentally become detached and as the holder 13 is welded to the support portion 12A, it and the container 17 will not swing as a brush is dipped in the container and wiped against its mouth as the brush is withdrawn.

The weight of the liquid within the container 17 is such that the plane inclusive of the center of the base and the axis of the support 12 is held vertically.

I claim:

1. An attachment for connecting a container for a liquid to one side of a ladder having tubular metal rungs, said attachment including a rigid member of a length and cross sectional dimensions providing an anchor portion to be freely inserted in a selected end of a selected one of the ladder rungs and a support portion then to extend laterally of the ladder, and a container holder suspended from the support portion said holder including a base and wall structure including opposite portions and rigidly connected thereto to said support portion with the center of gravity of the holder in vertical alignment with a plane inclusive of the mid points of said opposite portions and the center of said base also incusive of the axis of said support portion whereby when a container with liquid therein is connected to the ladder by the insertion of the anchor portion in the selected rung, said anchor portion is held in frictional engagement with the rung and said plane is vertical.

2. The attachment of claim 1 in which the wall structure includes side walls and said opposite portions are end walls, and said side walls spaced sufficiently below the anchor portion to enable a container to be entered in the holder and seated on said base.

3. The attachment of claim 1 in which the base is substantially square.

4. In combination, a container for a liquid such as a paint or a stain, said container consisting of the bottom portion of a plastic container such as a one gallon milk container and an attachment for connecting said container to one side of a ladder having tubular metal rungs, said attachment including a rigid member of a length and cross sectional dimensions providing an anchor portion to be freely inserted in a selected end of a selected one of the ladder rungs and a support portion then to extend laterally of the ladder, and a container holder suspended from the support portion, said holder including a base and wall structure, said wall structure including opposite portions rigidly connected to the support portion with the center of of the base in vertical alignment with a plane inclusive of the axis of said support portion and said holder confining the container against any appreciable movement relative thereto, said wall structure shaped and disposed to enable a container to be seated in said holder below the support portion, whereby when a container with liquid therein is connected to the ladder by the insertion of the anchor portion in a selected rung, said anchor portion is held by the weight thereof in frictional engagement with the rung and said plane is vertical.

* * * * *